US005335638A

United States Patent [19]

Mukai

[11] Patent Number: 5,335,638

[45] Date of Patent: Aug. 9, 1994

[54] EVAPORATED FUEL CONTROLLER

[75] Inventor: Takeshi Mukai, Shizuoka, Japan

[73] Assignee: Suzuki Motor Corporation, Shizuoka, Japan

[21] Appl. No.: 124,329

[22] Filed: Sep. 20, 1993

[30] Foreign Application Priority Data

Dec. 28, 1992 [JP] Japan ..... 4-361524

[51] Int. Cl.[5] ..... F02M 33/02

[52] U.S. Cl. ..... 123/520; 123/516

[58] Field of Search ..... 123/518, 519, 520, 521, 123/516, 198 D

[56] References Cited

U.S. PATENT DOCUMENTS

| | | | |
|---|---|---|---|
| 4,318,383 | 3/1982 | Iritani et al. . | |
| 4,700,683 | 10/1987 | Uranishi | 123/520 |
| 5,020,503 | 6/1991 | Kanasashi . | |
| 5,085,194 | 2/1992 | Kuroda et al. . | |
| 5,105,789 | 4/1992 | Aramaki et al. . | |
| 5,158,059 | 10/1992 | Kuroda . | |
| 5,230,319 | 7/1993 | Otsuka | 123/520 |
| 5,237,979 | 8/1993 | Hyodo | 123/520 |
| 5,253,629 | 10/1993 | Fornuto | 123/198 D |
| 5,267,547 | 12/1993 | Chikamatsu | 123/198 D |

FOREIGN PATENT DOCUMENTS

| | | | |
|---|---|---|---|
| 0007962 | 1/1987 | Japan | 123/519 |
| 2-130254 | 5/1990 | Japan . | |
| 3260365 | 11/1991 | Japan | 123/519 |
| 4132868 | 5/1992 | Japan | 123/519 |
| 5039754 | 2/1993 | Japan | 123/519 |
| 5039758 | 2/1993 | Japan | 123/519 |

*Primary Examiner*—Carl S. Miller

*Attorney, Agent, or Firm*—Flynn, Thiel, Boutell & Tanis

[57] ABSTRACT

An evaporated fuel controller including an evaporative fuel path having a first path communicating a fuel tank to a canister and a second path communicating the canister to an air intake path via a first solenoid valve, a pressure control valve provided in line with the first path, a canister communicated to the atmosphere via a second solenoid valve, a control path communicating the air intake path to the pressure control valve, a third solenoid valve provided in line with the control path, a pressure sensor to detect a pressure in the fuel tank, and a controller to provide controls for communicating the fuel tank to the canister by opening the third solenoid valve which opens the pressure control valve when any one of a group of engine operating conditions is not satisfied.

4 Claims, 3 Drawing Sheets

EVAPORATED FUEL CONTROLLER

CROSS REFERENCE TO RELATED APPLICATION

Cross reference is made to Applicant's prior filed co-pending patent application Ser. No. 08/066 981, filed May 25, 1993.

FIELD OF THE INVENTION

This invention relates to an evaporated fuel controller, and more particularly to an evaporated fuel controller having a canister, which absorbs and stores evaporated fuel, provided in a path communicating an air intake path of an engine to a fuel tank.

BACKGROUND OF THE INVENTION

Evaporated fuel leaked from a fuel tank, a float chamber of a carburetor or other engine sections contains a substantial amount of hydrocarbons and is a cause of air pollution and fuel loss. Various types of technology to prevent evaporated fuel leakage are known. One of the representative technologies is a system in which evaporated fuel from a fuel tank is absorbed and stored in a canister by an absorbent such as activated carbon therein, and the evaporated fuel once absorbed and stored in this canister is purged and supplied to the engine when it runs.

Japanese Patent Laid Open Publication No. 130254-1990 discloses an evaporated fuel processing apparatus for a fuel tank in an engine comprising a communicating path which communicates a fuel tank to a canister, a relay valve which opens and closes this communicating path, a shut down detecting means for detecting when the engine is shut off or the vehicle is stopped, and a driving means for opening the relay valve for a specified period of time after detecting an engine shut down or stopping of the vehicle. The result is that evaporated fuel in the fuel tank is introduced into and collected in the canister which substantially reduces the quantity of evaporated fuel released into the atmosphere from a fuel tank inlet port when the filler cap is opened.

A conventional type of evaporated fuel controller is shown in FIG. 4. A path 132 communicates a surge tank 108 located downstream from a throttle valve 106 to a fuel tank 116. The throttle valve 106 is disposed within an air intake path 110 of an engine (not shown). A canister 134 in line with path 132 absorbs and stores evaporated fuel. The path 132 comprises a first path 136 communicating the fuel tank 116 to the canister 134 and a second path 138 communicating the canister 134 to the air intake path 110. A check valve 140 is provided in the first path 136 between the fuel tank 116 and the canister 134. Check valve 140 sets a pressure in the fuel tank 116 and the canister 134 to a specified level thereby controlling the quantity of evaporated fuel (HC) generated in the fuel tank 116. The pressure in the fuel tank is set to a level slightly higher than the atmospheric pressure so that the pressure in the fuel tank is maintained at a constant level (pressure accumulation).

A throttle sensor (not shown) for detecting an opening degree of the throttle valve 106 and a solenoid valve 144 in line with the second path 138 are each connected to a controller (not shown).

During refueling operations, when cap 116A of the fuel tank 116 is opened, internal pressure in the tank is released to the atmosphere and evaporated fuel in the fuel tank (HC) is released, which causes air pollution. Starting in 1995, the United States will impose restrictions over evaporated fuel which require that the pressure in a fuel tank while an engine is running be held below a specified level, for instance, 10 inch mmAg or less. Development of an evaporated fuel controller which can satisfy this restriction is strongly desired.

In order to solve the problems as described above, an evaporated fuel system according to the present invention is characterized in that an evaporated fuel path is formed with a first path communicating a fuel tank to a canister and a second path communicating a canister to an air intake path, a pressure control valve is provided in the first path, a first solenoid valve is provided in the second path, the canister communicates with the atmosphere via a second solenoid valve, a communicating path communicates the air intake path to a pressure chamber of the pressure control valve, a third solenoid valve is provided in the communicating path, a pressure sensor detects pressure in the fuel tank, and a control means communicates the fuel tank to the canister by opening the third solenoid valve which in turn opens the pressure control valve when any one of specified conditions for running the engine are not satisfied.

As constructed according to the present invention as described above, when any one of the specified conditions for running the engine are not satisfied, the controller provides controls to communicate the fuel tank with the canister by opening the third solenoid valve which opens the pressure control valve.

DETAILED DESCRIPTION

Figure 1:
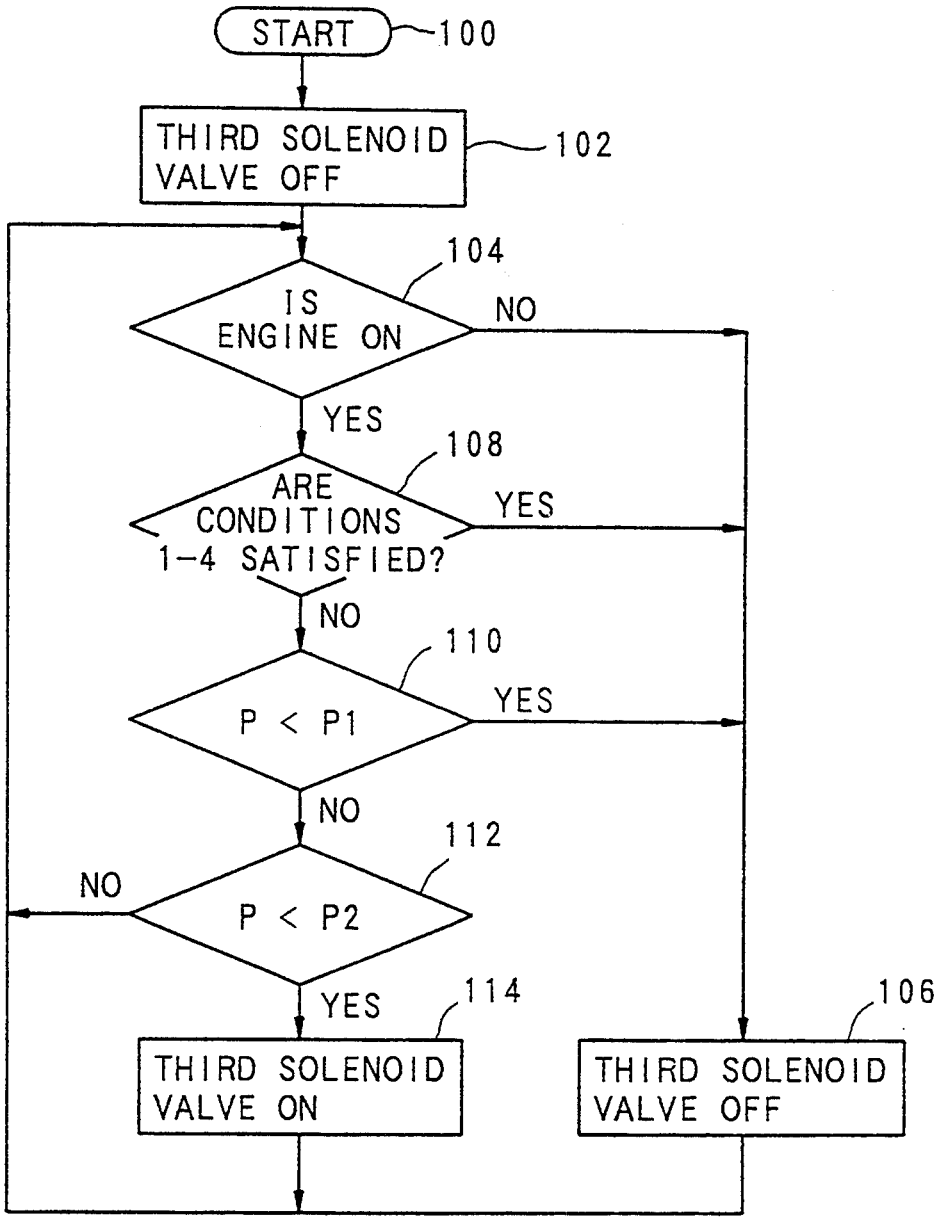
FIG. 1 is a flow chart illustrating the operation of an evaporated fuel controller according to the present invention.
Figure 2:
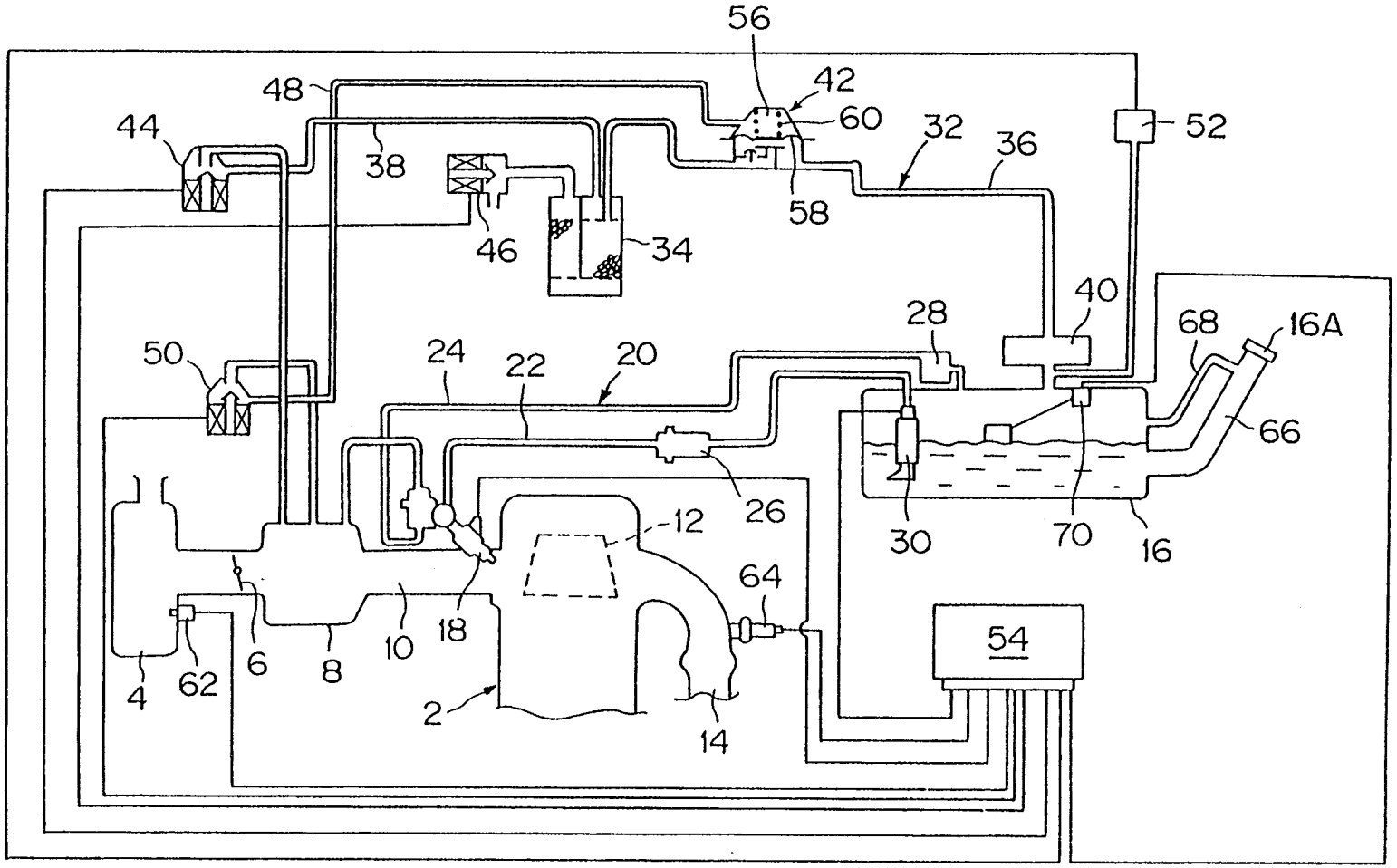
FIG. 2 is a block diagram illustrating the evaporated fuel controller.
Figure 3:
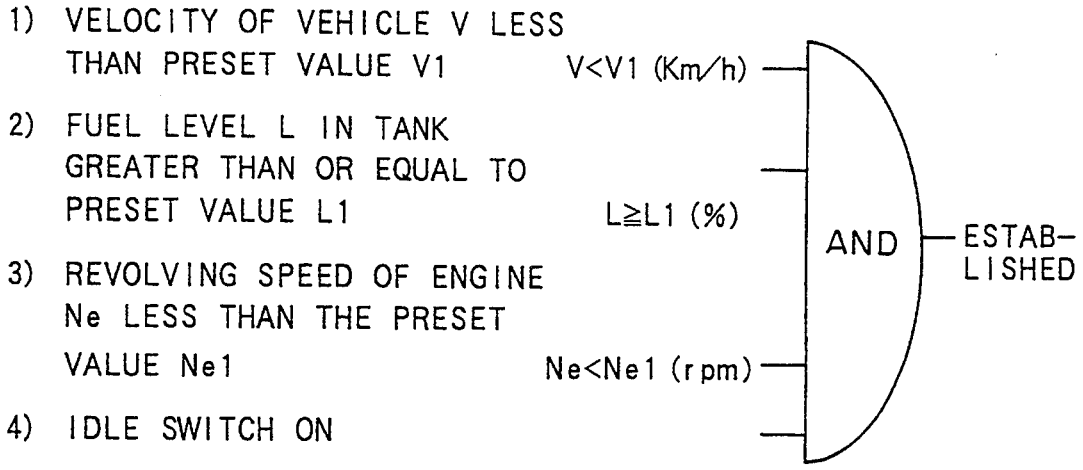
FIG. 3 is a drawing illustrating conditions 1–4 for turning off the third solenoid valve.
Figure 4:
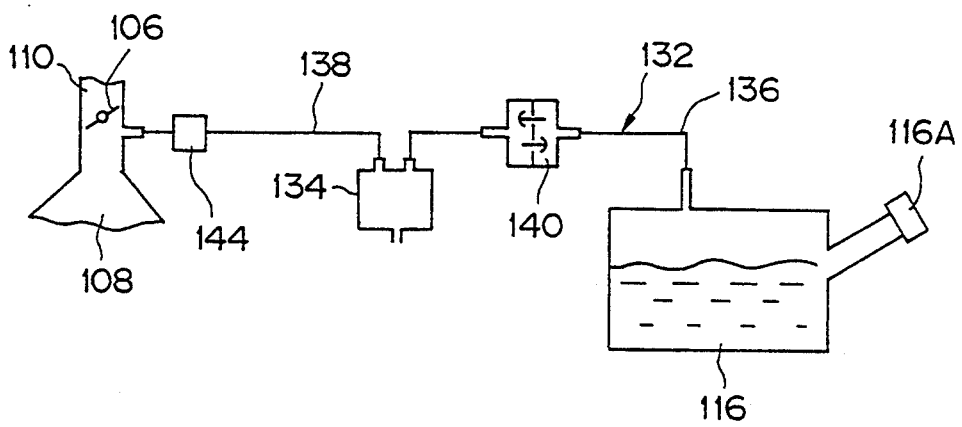
F I G. 4 PRIOR ART
FIG. 4 is a block diagram illustrating a conventional type of evaporated fuel controller.

FIGS. 1–3 illustrate a preferred embodiment of the present invention. In FIG. 2, 2 indicates an engine, 4 an air cleaner, 6 a throttle valve, 8 a surge tank, 10 an air intake path, 14 an air exhaust path, and 16 a fuel tank. A fuel injection valve 18 projects into the air intake path 10 and is oriented toward a combustion chamber 12. The fuel injection valve 18 communicates with the fuel tank 16 via a fuel path 20. A cap 16A is attached to fuel tank 16.

Fuel path 20 comprises a fuel supply path 22 to supply fuel from the fuel tank 16 to the fuel injection valve 18 and a fuel return path 24 to return surplus fuel to the fuel tank 16. A filter 26 is provided in line with the fuel supply path 22 while a return valve 28 is provided in line with the fuel return path 24. A fuel hose 66 communicates fuel supplied from a supply nozzle to the fuel tank 16, 68 indicates a breather hose of the fuel tank 16, and 70 indicates a fuel level gauge.

Fuel in the fuel tank 16 is sent by a fuel pump 30 via the fuel supply path 22 to the fuel injection valve 18 and is then sent together with air to the combustion chamber 12 for combustion therein. The exhaust gas generated in combustion is exhausted through the air exhaust path 14.

An evaporated fuel path 32 communicating a surge tank 8 downstream from the throttle valve 6 to the tank 16 is provided. A canister 34 to absorb and store evaporated fuel therein is provided in line with path 32. Evaporated fuel path 32 is formed with a first path 36 communicating the fuel tank 16 to the canister 34, and a second path 38 communicating the canister 34 to the air intake path 10. A check valve 40 is provided in line with the first path 36 which limits pressure in the fuel tank 16 and in the canister 22 to a specified level to suppress the quantity of evaporated fuel (HC) generated in the fuel tank 16.

A first solenoid valve 44 is provided in line with the second path 38 which permits the canister 34 to communicate with the air intake path 10 downstream from the throttle valve 6. A pressure control valve 42 is provided in line with the first path 36. When pressure control valve 42 is opened, the fuel tank 16 is communicated with the canister 34. The canister 34 communicates with the atmosphere via a second solenoid valve 46. A communicating or control path 48 communicates the air intake path 10 to the pressure control valve 42. A first end of the communicating path 48 communicates with the air intake path 10 downstream from the second path 38, and a second end communicates with a pressure chamber 56 of the pressure control valve 42. A third solenoid valve 50 is provided in line with the communicating path 48. A pressure sensor 52 detects a pressure in the fuel tank 16. A controller 54 opens the third solenoid valve 50 which in turn opens the pressure control valve 42 when any one of a group conditions for running the engine 2 are not satisfied. Controller 54 is typically a microprocessor, or equivalent.

The fuel injection valve 18, the fuel pump 30, the first solenoid valve 44, the second solenoid valve 46, the third solenoid valve 50, an intake air sensor 62 provided in the air cleaner, and an exhaust air sensor 64 to detect an oxygen density provided in the air exhaust path 14 are connected respectively to the controller 54.

With reference to pressure control valve 42, a diaphragm 58 is controlled by the driving force of a spring 60 for closing the pressure control valve 42. The pressure control valve 42 also has an independent check valve function, so that the driving force of the spring 60 is adjusted to open the pressure control valve 42 when pressure in the fuel tank rises up to or above, a preset level.

When any one of a number of engine operating conditions are not satisfied, namely when any one of the following conditions are not satisfied:

1) velocity V of the vehicle is less than a preset value V1 ($V<V1$ (Km/h);
2) fuel level L in the fuel tank is greater than or equal to a preset value L1 ($L \geqq L1$ (%));
3) r.p.m. of the engine Ne is less than a preset value Ne1 ($Ne<Ne1$); and
4) the idle switch is ON, and in addition when pressure P in the fuel tank is not less than a first preset value P1, and at the same time the pressure P in the fuel tank exceeds a second preset value P2 which is larger than the first preset value P1, the controller 54 opens the third solenoid valve 50 which in turn opens the pressure control valve 42 by making use of negative pressure in the air intake path 10.

The following is a description of the operation of the evaporated fuel controller with reference to the flow chart of FIG. 1.

When a control program in the controller 54 is started at step 100, the controller 54 insures that the third solenoid valve 50 (hereinafter referred to as the three-directional VSV) is OFF at step 102, and then makes a determination as to whether the engine 2 is ON or not at step 104.

If the engine is not ON, the controller 54 turns OFF the third solenoid valve 50 at step 106, and returns to step 104.

If the result of step 104 is YES, the controller D4 makes a determination as to whether conditions 1–4 as illustrated in FIG. 3 are satisfied or not. If conditions 1–4 are satisfied, the controller returns to step 106.

If any one of the conditions 1–4 are not satisfied, the controller 54 makes a determination as to whether the pressure P in the fuel tank 16 is less than the first preset value P1 at step 110. If the result is YES at step 110, control goes to step 106. If the result of step 110 is NO, the controller 54 makes a determination as to whether the pressure P in the fuel tank 16 is greater than the second preset value P2. If the result of step 112 is NO, control returns to step 104. If the result of the step 112 is YES, the controller 54 turns ON the third solenoid valve 50 at step 114, and then control returns to step 104. When third solenoid valve 50 is ON, negative pressure is communicated to the pressure chamber 56 of pressure control valve 42 via communicating path 48 which in turn opens control valve 42 to permit evaporated fuel from the fuel tank 16 to flow into the canister 34.

With the operations as described above, the communication between the fuel tank 16 and the canister 34 can be disconnected when the engine 2 stops running, i.e., the third solenoid valve 50 is closed. When the pressure in the fuel tank is equal to or greater than a preset value with the engine 2 OFF, the pressure control valve 42 can be opened against the driving force of the spring 58 and the internal pressure in the fuel tank can be reduced by the check valve function of the pressure control valve 42 to less than the preset value. Therefore, when the cap 16A of the fuel tank 16 is opened during refueling, the internal pressure in the tank is not greater than the atmospheric pressure and evaporated fuel in the fuel tank 16 is not released to the atmosphere thereby eliminating one of the causes of air pollution.

When the third solenoid valve is ON while the engine 2 is running, the fuel tank 16 is communicated to the canister 34 to maintain a pressure in the fuel tank at a low level, which is practically advantageous.

As described in detail above, a path 32 is formed with a first path 36 communicating a fuel tank 16 to a canister 34 and a second path 38 communicating the canister to an air intake path 10, a pressure control valve 42 is provided in line with the first path, a first solenoid valve 44 is provided in line with the second path, the canister is communicated to the atmosphere via a second solenoid valve 46, a communicating path 48 communicating the air intake path to the pressure control valve is provided with a third solenoid valve 50 in line with the communicating path, a pressure sensor 52 communicates with the fuel tank, and a controller 54 provides control signals for communicating the fuel tank to the canister by opening the third solenoid valve 50 which opens the pressure control valve 42 when any one of the engine operating conditions are not satisfied so that the fuel tank can be communicated to the canister while the engine is running and a pressure in the tank can be maintained at a low level which is advantageous for practical purposes.

Additionally, communication between the fuel tank and the canister can be disconnected when the engine stops running. The pressure control valve 42 can then be opened by a check valve function thereof when pressure in the tank is equal to or greater than a predetermined value. The result is that the pressure in the tank can be held to a low level so that the pressure in the tank is not released to the atmosphere when a cap of the fuel tank is opened during refueling. Therefore, evaporated fuel in the fuel tank (HC) is not released to the atmosphere, thereby eliminating one of the causes for air pollution.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An evaporated fuel controller comprising: a canister provided in line with an evaporated fuel path communicating an air intake path of an engine to a fuel tank, said evaporated fuel path having a first path communicating the fuel tank to the canister and a second path communicating the canister to the air intake path; a pressure control valve in line with the first path; a first solenoid valve in line with the second path; a second solenoid valve to communicate the canister with the atmosphere; a control path communicating the air intake path to the pressure control valve; a third solenoid valve provided in line with the control path; a pressure sensor for detecting a pressure in the fuel tank; and control means for opening the third solenoid valve to communicate the fuel tank with the canister when at least one engine operating condition is not satisfied.

2. An evaporated fuel system for a vehicle comprising:

an evaporated fuel passage coupling a fuel tank to an air intake path of an engine;

a canister disposed in line with said evaporated fuel passage for absorbing and storing evaporated fuel generated in said fuel tank, said evaporated fuel passage defining a first passage disposed between said fuel tank and said canister, and a second passage disposed between said canister and said air intake path; and a controller including pressure control valve means disposed in line with said first passage for communicating said fuel tank to said canister when said pressure control valve means is open; first solenoid valve means disposed in line with said second passage for communicating said canister to said air intake path when said first solenoid valve means is open; second solenoid valve means for communicating an air intake port of said canister with the atmosphere when said second solenoid valve means is open; a control passage for communicating said air intake path to a pressure chamber of said pressure control valve means; third solenoid valve means disposed in line with said control passage for communicating the air intake path to said pressure chamber to effect opening of said pressure control valve means when said third solenoid valve means is activated; pressure sensing means for detecting a pressure in said fuel tank; and control means for activating said third solenoid valve means when said control means determines that at least one of a group of predetermined engine operating conditions is not satisfied and that a pressure in said fuel tank is not less than a first preset pressure value and at the same time greater than a second preset pressure value.

3. The evaporated fuel system as claimed in claim 2, wherein said at least one of said group of predetermined engine operating conditions is from the group consisting of a velocity of the vehicle is less than a preset velocity value, a fuel level in said fuel tank is greater than or equal to a preset fuel level value, an engine rpm is less than a preset engine rpm value, and an idle switch is active.

4. The evaporated fuel system as claimed in claim 2, wherein said first preset pressure value is less than said second preset pressure value.

* * * * *